US006627010B1

(12) United States Patent
Reiso et al.

(10) Patent No.: US 6,627,010 B1
(45) Date of Patent: Sep. 30, 2003

(54) METHOD FOR THE PRODUCTION OF ALLOYS FORM EUTECTIC ALLOY SYSTEMS

(75) Inventors: Oddvin Reiso, Sunndalsøra (NO); Ulf Tundal, Sunndalsøra (NO); John Erik Hafsås, Sunndalsøra (NO); Oddgeir Sjøthun, Sunndalsøra (NO)

(73) Assignee: Norsk Hydro ASA, Oslo (NO)

( * ) Notice: Subject to any disclaimer, the term of this patent is extended or adjusted under 35 U.S.C. 154(b) by 193 days.

(21) Appl. No.: 09/180,464

(22) PCT Filed: May 9, 1997

(86) PCT No.: PCT/NO97/00120

§ 371 (c)(1),
(2), (4) Date: Jul. 9, 1999

(87) PCT Pub. No.: WO97/43459

PCT Pub. Date: Nov. 20, 1997

(30) Foreign Application Priority Data

May 10, 1996 (NO) ..... 961930

(51) Int. Cl.[7] ..... C22F 1/05; C22F 1/04

(52) U.S. Cl. ..... 148/549; 148/690; 148/700; 148/702

(58) Field of Search ..... 148/549, 690, 148/700, 702

(56) References Cited

U.S. PATENT DOCUMENTS

| | | | | |
|---|---|---|---|---|
| 3,019,144 A | | 1/1962 | Murphy et al. | |
| 3,222,227 A | | 12/1965 | Baugh et al. | |
| 3,379,583 A | | 4/1968 | Gruhl et al. | |
| 4,909,858 A | * | 3/1990 | Reiso | 148/2 |
| 5,192,378 A | * | 3/1993 | Doherty et al. | 148/691 |
| 5,520,754 A | * | 5/1996 | Yaney et al. | 148/550 |
| 5,529,645 A | * | 6/1996 | Oswalt | 148/549 |
| 5,582,660 A | * | 12/1996 | Erickson et al. | 148/688 |

FOREIGN PATENT DOCUMENTS

| | | |
|---|---|---|
| EP | 0222479 | 5/1987 |
| EP | 0302623 | 2/1989 |
| NO | 166879 | 6/1991 |
| NO | 167214 | 7/1991 |

OTHER PUBLICATIONS

"ASM Handbook vol. 4, Heat Treating," pp. 851–853. 1994.*

* cited by examiner

*Primary Examiner*—Roy King
*Assistant Examiner*—Janelle Combs Morillo
(74) *Attorney, Agent, or Firm*—Wenderoth, Lind & Ponack, L.L.P.

(57) ABSTRACT

The present invention concerns procedures for producing an alloy from a eutectic alloy system, in order to form a workpiece for rolling or extrusion purposes by, for example, producing an Al—Mg—Si alloy, which can be precipitation-hardened, which alloy, after having been heated to a temperature above the solubility temperature of phases which can be precipitated, is kept at this temperature until the phases have dissolved and is cooled at a cooling rate which is rapid enough to avoid most of the precipitation of the phases and slow enough to avoid most of the precipitation of dispersoid particles. At cooling rates within this interval, most coarse phases which have a reductive effect on the processing rate can be avoided and, at the same time, the number of small dispersoid particles which have a reductive effect on the mechanical properties after hardening is limited.

7 Claims, 3 Drawing Sheets

METHOD FOR THE PRODUCTION OF ALLOYS FORM EUTECTIC ALLOY SYSTEMS

This application is a 371 application of PCT/NO97/00120 filed May 9, 1997.

The present invention concerns a procedure for the production of alloys from eutectic alloy systems, preferably Al alloys, in order to form workpieces such as a billet, ingot or slug for forging, cold flow pressing, rolling or extrusion purposes, by, for example, producing an Al—Mg—Si alloy, which can be precipitation-hardened, with 0.35–1.5% weight Mg, 0.35–1.3% weight Si, 0–0.50% weight Fe, 0–1.0% weight Mn, 0–0.05% weight Ti, 0–0.4% weight Cr, 0–0.50% weight Cu with the rest Al and impurities up to a maximum of 0.05% each and 0.15% in total, where the alloy melt is cast to form a workpiece.

In an extrusion plant for the production of aluminium profiles, the aluminium is fed into extrusion devices in the form of workpieces of suitable sizes which are first heated to a suitable temperature which is high enough for extrusion. In general terms, the extrusion devices consist of a cylinder piston device in which the cylinder is provided at one end with a tool in the form of an extrusion die. The aluminium is pressed through the extrusion die with the required cross-section or shape. Alternatively, the workpieces can be fed directly from production to the extrusion plant. In this case the preheating stage will be superfluous.

NO Pat. No. 166 879 discloses a procedure for producing an Al alloy, for example to form an ingot or slug for extrusion purposes, by, for example, producing an Al—Mg—Si alloy, which can be precipitation-hardened, where the alloy melt is cast to form a block or bar, is homogenised and then cooled. The subsequent stages involve the block being heated to a temperature above the solubility temperature of the precipitated secondary particles in the Al matrix and kept at this temperature until the precipitated phases in the Al matrix are dissolved. It is then cooled to the desired extrusion temperature rapidly enough to avoid re-precipitation of the said phases in the alloy structure. Alternatively, the block may be extruded at the said solubility temperature.

This procedure, which will apply to all Al alloys in which local melting arises on account of precipitated phases which are soluble at a higher temperature, represents an improvement regarding extrusion rate, surface quality and strength.

As stated in NO 166 879, the cooling rate, after the alloy has been heated to a temperature above the solubility limit for phases containing, for example, Mg and Si, is decisive for avoiding the precipitation of new, coarse Mg—Si phases. Such phases, together with the surrounding Al matrix, have a lower melting temperature than the rest of the alloy and incipient or preliminary melting (local melting) will, therefore, arise in the phases when the temperature in the metal being processed reaches the melting temperature of the phases together with the surrounding matrix. This will initiate tearing in the metal during processing. By avoiding an agglomeration of phases which have a lower melting temperature than the other parts of the metal, such as the coarse Mg—Si phases, local melting can be avoided, which will mean that the extrusion rate can be increased.

One disadvantage of the said procedure is that if the alloy is cooled too rapidly before extrusion, for example by water cooling, the properties in the finished product may deteriorate, for example reduced mechanical properties after hardening. Furthermore, the actual tensile strength of extrudates from such bars has been found to be highly dependent on the preheating temperature of the bars on account of a temperature-dependent cooling sensitivity in the material.

The above reduction in mechanical properties can be countered by cooling the product after processing (extrudate) at a sufficiently high cooling rate. This usually involves water cooling of extrudates, which entails major disadvantages.

With the present invention, an upper value has been arrived at for the cooling rate in connection with the production of alloys, which is based on new knowledge about the state of the alloy when an excessively high cooling rate is used. If this value is too high, the mechanical properties in the finished product are reduced on account of the above-mentioned increasing cooling sensitivity. Furthermore, a lower, minimum cooling rate has been arrived at, which is sufficient to avoid the undesired precipitation of coarse alloy phases.

The present invention concerns three procedures for producing alloys from eutectic alloy systems, which include an indication of an interval for the cooling rate in connection with the production of the alloys, whereby high productivity (high extrusion rate) and good mechanical properties can be optimised.

The first procedure is used for workpieces which are first teemed and homogenised and which are, for example, stored, transported, etc. before further processing, which workpieces are heated above the solubility temperature of the precipitated phases in the alloy, and the workpiece is cooled to the processing temperature at a cooling rate which is rapid enough to avoid most of the precipitation of the said phases and slow enough to avoid most of the precipitation of dispersoid particles.

The second procedure concerns workpieces which are cast and homogenised, whereby cooling after homogenisation takes place within the same cooling rate interval as in the first precedure.

The third procedure concerns cast workpieces of an alloy, which workpieces are preheated and homogenised in a combined operation, whereby cooling to the processing temperature takes place within the cooling rate interval defined in the first precedure.

In one embodiment the workpiece is cooled, after homogenisation or casting, at a rate which is high enough, for example 55,000° C./hour (water cooling) to suppress the precipitation of phases such as particles containing Mg—Si.

The preferred lower and upper limits for the cooling rate are greater than 400° C./h and less than 55,000° C./h.

The present invention will now be described in further detail using the following figures and examples.

Figure 1:
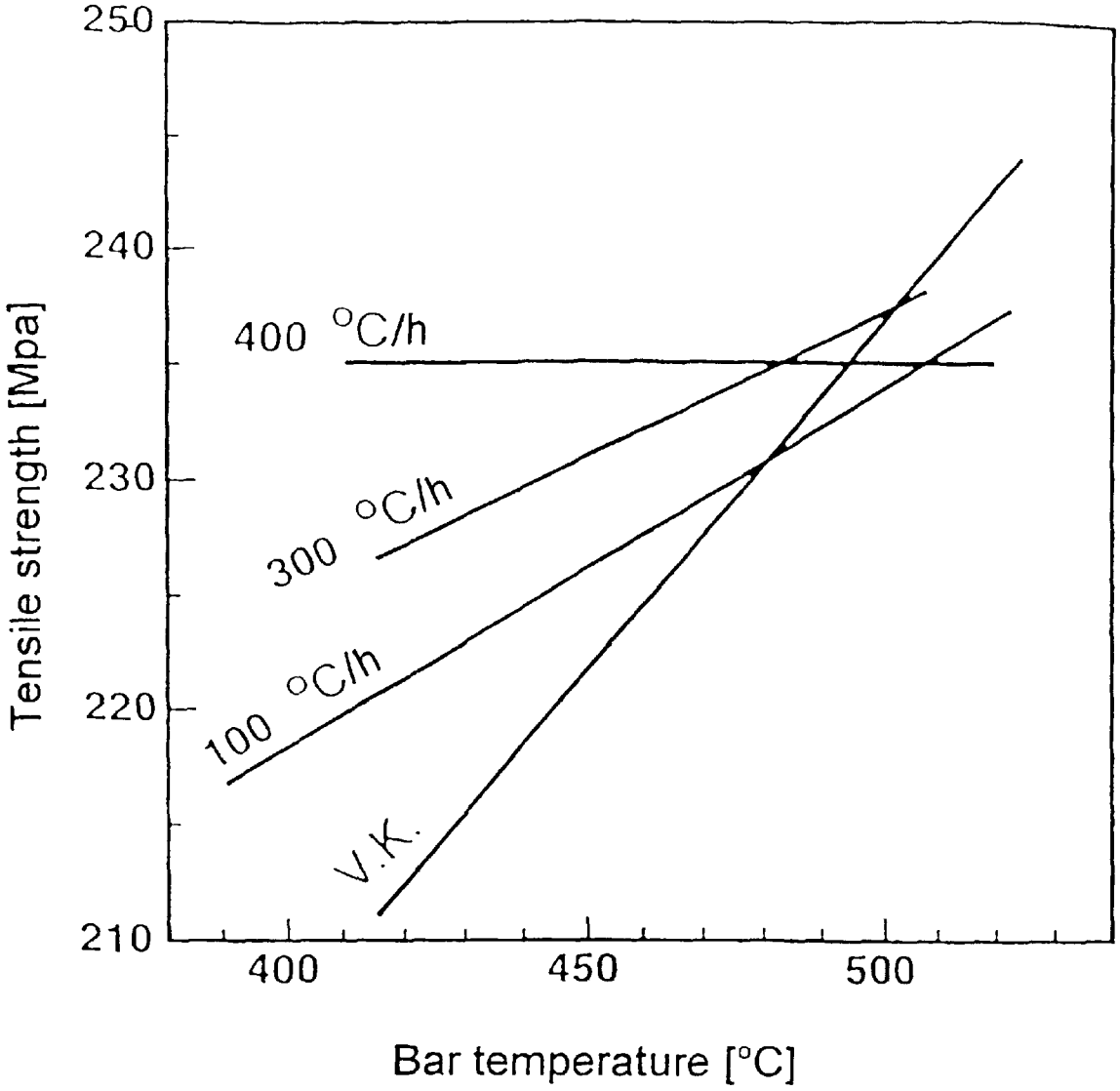
FIG. 1 shows the tensile strength of extrudates as a function of the extrusion billet's preheating temperature for different cooling rates after homogenisation.

As can be seen in FIG. 1, tests have been carried out with different cooling rates of the billets after homogenisation. The alloy in the billets consists of an Al—Mg—Si alloy which covers the compositions in AA 6060 and AA 6063, with 0.50% weight Mg, 0.53% weight Si, 0.20% weight Fe and 0.01% weight Mn. The figure shows that the tensile strength of the billets cooled at rates of 100° C./h and 300° C./h increases regularly with the billets preheating temperature. The tensile strength for billets cooled at 400° C./h is not influenced very much by the billets preheating temperature while the water-cooled billets have low values for tensile strength, which, however, increases rapidly with the preheating temperature.

It should be added that the cooling rate will vary with the dimensions of the workpiece. However, in general, the above rates up to 400° C./h can be achieved by air-cooling, possibly using a fan, while water cooling is likely to represent rates equivalent to 55,000° C./h.

Figure 2:
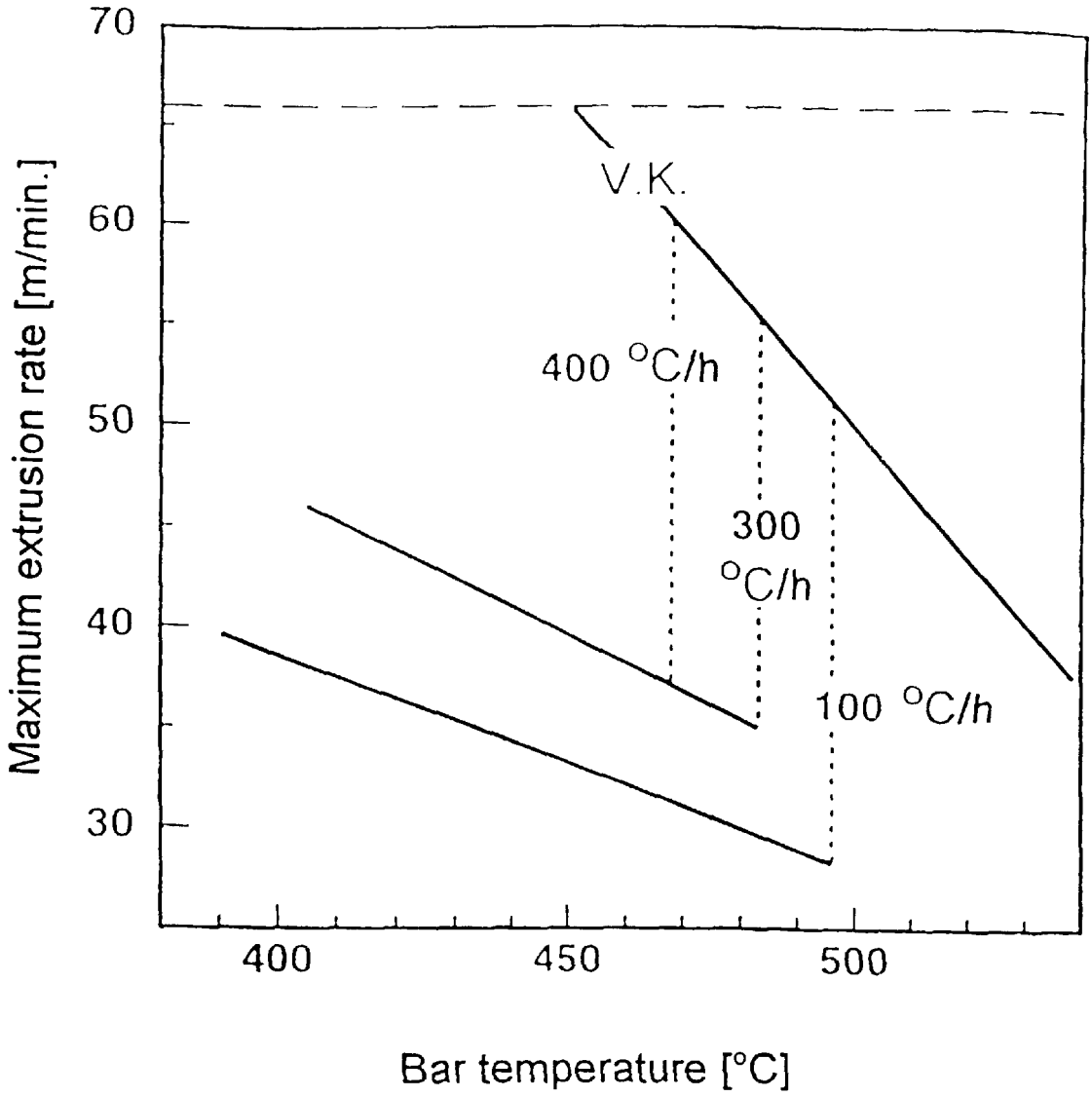
FIG. 2 shows the maximum extrusion rate (before tearing) as a function of the billet's preheating temperature for different cooling rates after homogenisation.

FIG. 2 shows the maximum extrusion rate as a function of the preheating temperature of the billets for different cooling rates after homogenisation. As the figure shows, billets cooled at a rate of 100° C./h will have low extrusion rates, which decrease uniformly with the preheating temperature of the billet until the solubility temperature is reached. This is on account of local melting in the alloy and the higher the starting temperature the lower the extrusion rate must be on account of heat generation and an increase in temperature during extrusion. The vertical dotted line is produced as a consequence of the coarse phases dissolving and when this stage is reached, the extrusion rate can be increased considerably. Billets which are water-cooled after homogenisation can generally be extruded at high rates, even with low preheating temperatures of the bars.

The present invention is based on new knowledge on alloys from eutectic alloy systems; it has been found that if the cooling rate during the production of the alloy is too high, a new precipitation reaction, which has not previously been demonstrated, will have a major effect on the properties of the alloy, such as tensile strength and possibly the anodising properties, in the finished product.

Studies carried out with an electron microscope show that extrudates from water-cooled billets have a high content, in terms of numbers, of small (10–30 nm) dispersoid particles. Equivalent studies of extrudates from air-cooled billets show a much lower content of these particles.

Figure 3:
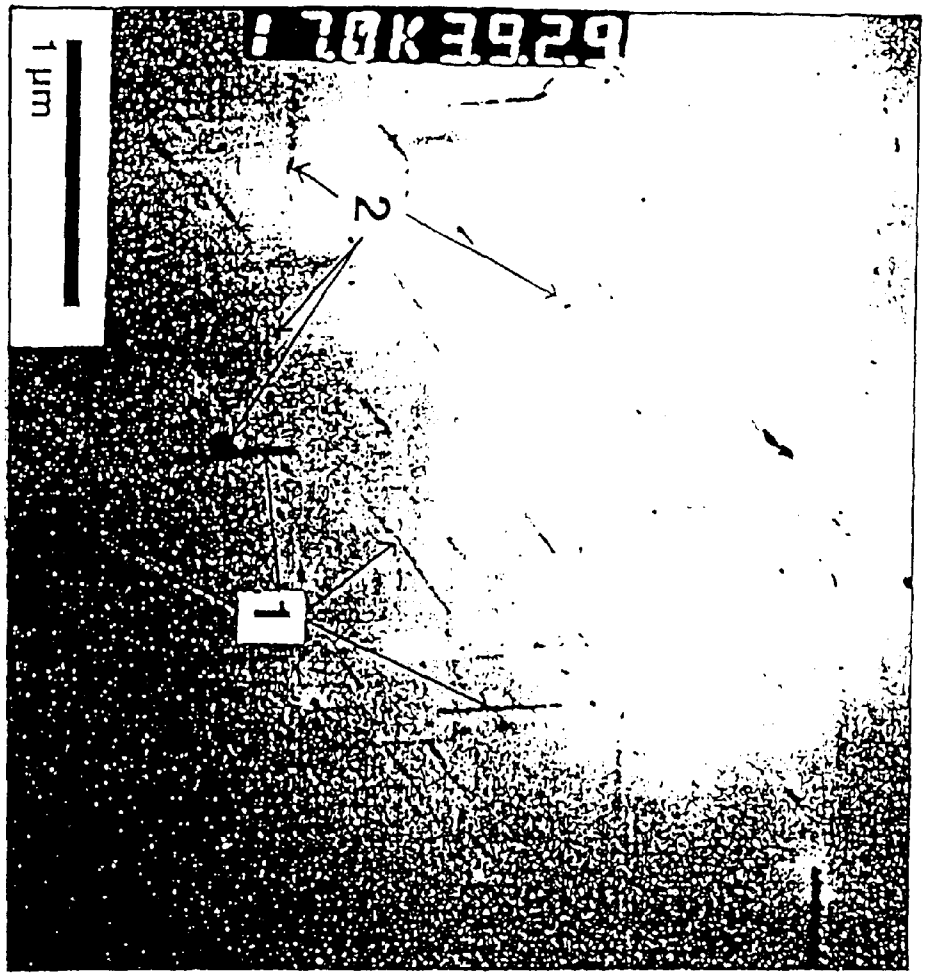
FIG. 3 shows a picture of dispersoid particles (2) and particles containing β'-Mg—Si (1).

FIG. 3 shows a picture taken with an electron microscope of a profile from a billet which was water-cooled after homogenisation. The picture shows rod-shaped β'-Mg—Si particles (1) and round AlFe(Mn)Si dispersoid particles (2) (the few large round dispersoid particles were formed during the homogenisation annealing, the many small round dispersoid particles were precipitated during the preheating of the bar before extrusion).

The small dispersoid particles were identified as two different types of AlFe(Mn)Si phase particles, one of which is equivalent to a bcc α-AlFe(Mn)Si phase and the other an AlFe(Mn)Si phase particle with a hexagonal unit cell and lattice parameters a=6.70A and c=8.14A and is probably a semi-coherent particle type with the c-axis parallel with a <100> direction to the Al lattice. This particle type has not previously been demonstrated. Nor has the precipitation of these types of dispersoid particles previously been demonstrated in connection with an equivalent heat treatment process.

The number of small dispersoid particles precipitated during preheating was found to be high in connection with bars water-cooled after homogenisation. This was probably on account of improved conditions for nucleation for the particles in these billets in comparison with billets which are air-cooled from the homogenisation temperature.

The number of precipitated dispersoid particles was also found to decrease as the preheating temperature increases.

The small precipitated dispersoid particles act as very effective nucleators for β'-Mg—Si phase particles which can thus be precipitated more easily during cooling after processing (extrusion). This thus results in increased cooling sensitivity for the material. The β'-Mg—Si particles contribute very little to the hardening of the alloy. On the contrary, they lead to the available Mg and Si for forming hardening β"-Mg—Si particles being reduced and the alloy is less stable. Variations in the quantity of such precipitated particles will, therefore, result in variations in the tensile strength of the cooled extrudates. The number of β'-Mg—Si particles will vary with the number of dispersoid particles on account of the dispersoid particles' effect as nucleators for the β' particles. Thus the tensile strength of the profiles will be lower the higher the number of dispersoid particles in the material. This explains the observed variations in the tensile strength in respect of the billet temperature in the extrudates from water-cooled billets and, at the same time, the higher mechanical properties observed in extrudates from billets which were air-cooled after homogenisation. This also means that the variations in tensile strength depend to a great degree on the cooling rate after processing (extrusion). If this is high enough, precipitation of β'-Mg—Si particles is avoided and full mechanical properties in the profile can be achieved.

Even though the above example is based on alloys from eutectic alloy systems in connection with the extrusion of billets, equivalent precipitation mechanisms will also apply to other processing methods such as rolling, forging or cold flow pressing.

Otherwise, the cooling rate will depend on the alloy. A general rule of thumb is that lower-alloyed material can be cooled at lower rates than higher-alloyed material.

It was observed that extrudates from water-cooled bars preheated to approximately 540° C. (superheated) and then cooled to extrusion temperature contained, in terms of numbers, few precipitated dispersoid particles and thus had high tensile strength values. I.e. the strength-reducing effect of the precipitation of dispersoid particles in connection with water cooling after homogenisation can be countered by superheating before processing. However, it is important that the cooling to the processing temperature is not too rapid in order to avoid re-precipitation of dispersoid particles and that it is not too slow in order to avoid the precipitation of coarse phases containing Mg—Si. The advantages of using billets which are water-cooled after homogenisation combined with superheating the bars before extrusion are that the particles containing Mg—Si are dissolved more rapidly and that the necessary dwell time at temperatures above the solubility temperature of the alloy is reduced. The superheating stage is thus simpler to control.

What is claimed is:

1. A method for producing an alloy from an aluminum eutectic alloy system, in order to form a workpiece, which comprises, prior to any rolling, extrusion or other working of the alloy, casting and cooling an aluminum alloy melt to form a workpiece, homogenizing and cooling the alloy in the workpiece, heating the workpiece to a temperature in the alloy above the solubility temperature of the precipitated phases in the alloy matrix, keeping the workpiece at the temperature above the solubility temperature of the precipitated phases in the matrix until the phases have dissolved, cooling the workpiece to the desired processing temperature at a cooling rate greater than 400° C./h and less than 55,000° C./h which is rapid enough to avoid most of the precipitation of the said phases and slow enough to avoid most of the precipitation of dispersoid particles.

2. The method according to claim 1, wherein the alloy is an Al—Mg—Si alloy, which can be precipitation-hardened, with 0.35–1.5% weight Mg, 0.35–1.3% weight Si, 0–0.5% weight Fe, 0–1.0% weight Mn, 0–0.05% weight Ti, 0–0.4% weight Cr, 0–0.5% weight Cu with the rest Al and impurities up to a maximum of 0.05% each and 0.15% in total.

3. The method according to claim 1, wherein the workpiece is a billet, ingot or slug for rolling or extrusion purposes.

4. A method according to claim 1, wherein the workpiece is cooled, after homogenisation, at a cooling rate which is high enough to suppress the precipitation of the said phases.

5. The method according to claim 4, wherein the cooling rate after homogenisation is 55,000° C./hour.

6. The method according to claim 4, wherein the cooling rate after homogenisation is high enough to suppress precipitation of particles containing Mg—Si.

7. The method according to claim 1, wherein the workpiece is formed from an Al—Mg—Si alloy and the solubility temperature is the solubility temperature of the Mg—Si phases in the workpiece.

* * * * *